US007557508B2

(12) United States Patent
Kim et al.

(10) Patent No.: US 7,557,508 B2
(45) Date of Patent: Jul. 7, 2009

(54) PLASMA DISPLAY PANEL COMPRISING OPAQUE ELECTRODES

(75) Inventors: Ki-Jung Kim, Suwon-si (KR); Tae-Kyoung Kang, Suwon-si (KR)

(73) Assignee: Samsung SDI Co. Ltd., Suwon-si, Gyeonggi-do (KR)

( * ) Notice: Subject to any disclaimer, the term of this patent is extended or adjusted under 35 U.S.C. 154(b) by 447 days.

(21) Appl. No.: 11/272,827

(22) Filed: Nov. 15, 2005

(65) Prior Publication Data

US 2006/0103296 A1 May 18, 2006

(30) Foreign Application Priority Data

Nov. 15, 2004 (KR) ..... 10-2004-0093071

(51) Int. Cl.
*H01J 17/49* (2006.01)

(52) U.S. Cl. ..... 313/585; 313/582; 313/583; 313/584; 313/586; 313/587

(58) Field of Classification Search ..... 313/582–587, 313/520, 402; 315/169.1, 169.4; 257/59, 257/72; 348/37, 41, 60, 71
See application file for complete search history.

(56) References Cited

U.S. PATENT DOCUMENTS

| | | | | |
|---|---|---|---|---|
| 5,900,694 | A * | 5/1999 | Matsuzaki et al. | 313/484 |
| 6,097,149 | A * | 8/2000 | Miyaji et al. | 313/582 |
| 6,137,226 | A * | 10/2000 | Nagano | 313/582 |
| 6,184,620 | B1 * | 2/2001 | Mori et al. | 313/585 |
| 6,538,381 | B1 | 3/2003 | Ueoka et al. | |
| 6,614,183 | B2 * | 9/2003 | Masuda et al. | 313/586 |
| 6,703,782 | B2 * | 3/2004 | Otani et al. | 313/585 |
| 6,891,331 | B2 * | 5/2005 | Ashida et al. | 313/582 |
| RE40,104 | E * | 2/2008 | Miyaji et al. | 313/582 |
| 2002/0008475 | A1 * | 1/2002 | Yoshioka et al. | 313/586 |
| 2004/0130268 | A1 | 7/2004 | Mun et al. | |
| 2004/0239246 | A1 * | 12/2004 | Asida et al. | 313/582 |
| 2005/0041001 | A1 * | 2/2005 | Sumida et al. | 345/60 |

FOREIGN PATENT DOCUMENTS

| | | | |
|---|---|---|---|
| CN | 1 541 399 | | 10/2004 |
| EP | 1 326 263 | | 7/2003 |
| EP | 1408527 | A1 * | 4/2004 |
| JP | 06-020605 | A | 1/1994 |
| JP | 10-149774 | A | 6/1998 |
| JP | 2001-052620 | A | 2/2001 |
| JP | 2003-016947 | A | 1/2003 |
| JP | 2003-187692 | | 7/2003 |
| JP | 2004-193141 | | 7/2004 |
| WO | WO 02/19369 | A1 | 3/2002 |

* cited by examiner

*Primary Examiner*—Sikha Roy
*Assistant Examiner*—Jose M Diaz
(74) *Attorney, Agent, or Firm*—Lee & Morse, P.C.

(57) ABSTRACT

A plasma display panel plasma display panel includes a first substrate, a second substrate facing the first substrate, address electrodes between the first and second substrates, barrier ribs between the first and the second substrates, the barrier ribs defining discharge cells, phosphor in each discharge cell and first and second opaque electrodes between the first and second substrates, the first and second opaque electrodes extending orthogonally to the address electrodes. Each opaque electrode includes a first layer and a second layer, the first layer being narrower than the second layer. Each discharge cell is between a corresponding address electrode on a first side and a corresponding pair of first and second opaque electrodes on a second side, opposite the first side.

20 Claims, 3 Drawing Sheets

PLASMA DISPLAY PANEL COMPRISING OPAQUE ELECTRODES

BACKGROUND OF THE INVENTION

1. Field of the Invention

The present invention relates to a plasma display panel. In particular, the present invention relates to a plasma display panel which enhances luminance by maximizing transmittance of visible light from sustain discharge.

2. Description of the Related Art

Generally, a plasma display panel (PDP) includes a front substrate and a rear substrate sealed to each other at their edges and an inert gas filling discharges cells having phosphor therein formed between two substrates. Gas discharge occurs inside the discharge cells. The PDP produces an image by generating a plasma from gas discharge in the discharge cells, which emits vacuum ultraviolet rays, which, in turn, excite phosphors to emit elementary colors needed for display, e.g., red, green and blue light.

The rear substrate typically includes address electrodes formed on one side, a dielectric layer covering the address electrodes, barrier ribs on the dielectric layer and a phosphor layer on the side surfaces of the barrier ribs. The front substrate facing the rear substrate typically includes display electrodes thereon, formed in pairs of a sustain electrode and a scan electrode, in a direction orthogonal to an extending direction of the address electrodes. The display electrodes may be covered with a dielectric layer and a protective layer The display electrodes serving to produce the gas discharge typically include transparent electrodes and bus electrodes. The transparent electrodes are made of a transparent material in order to minimize an amount visible light emitted from the discharge cell blocked by the display electrodes and to maximize the transmittance of the visible light to the front substrate. However, transparent electrodes are expensive to manufacture.

In an attempt to reduce manufacturing costs of the PDP, display electrodes having only bus electrodes with excellent conductance, i.e., having no transparent electrodes, may be used. A bus electrode typically includes a black layer absorbing outside light for enhancing contrast and a white layer for improving conductance. However, the black layer of the bus electrode degrades the luminance of the PDP by absorbing some of the visible light emitted from the discharge cell during the operation of the PDP.

SUMMARY OF THE INVENTION

The present invention is therefore directed to plasma display device, which substantially overcomes one or more of the problems due to the limitations and disadvantages of the related art.

It is a feature of an embodiment of the present invention to provide a plasma display panel which enhances luminance by increasing transmittance of visible light generated during sustain discharge.

It is another feature of an embodiment of the present invention to provide a plasma display panel that redirects visible light heading toward black layers of the bus electrodes generated during the sustain discharge to a viewing surface.

At least one of the above and other features and advantages of the present invention may be realized by providing a plasma display panel, including a first substrate, a second substrate facing the first substrate, address electrodes between the first and second substrates, barrier ribs between the first and the second substrates, the barrier ribs defining discharge cells, phosphor in each discharge cell and first and second opaque electrodes between the first and second substrates. The first and second opaque electrodes extend orthogonally to the address electrodes. Each opaque electrode includes a first layer and a second layer, the first layer being narrower than the second layer. Each discharge cell is between a corresponding address electrode on a first side and a corresponding pair of first and second opaque electrodes on a second side, opposite the first side.

The first layer may be a black layer and the second layer may be a white layer. The first layer may include at least one component selected from a group including cobalt (Co), chromium (Cr) and ruthenium (III) oxide ($Ru_2O_3$), and the second layer may include silver (Ag) or aluminum (Al). The first layer may be on a second substrate side, and the second layer may be on a discharge cell side. The second layer may be narrower on the second substrate side than on the discharge cell side. An edge of the second layer may be inclined. Each opaque electrode may include a main electrode and a sub-electrode in parallel or a pair of sub-electrodes in parallel, the sub-electrodes being on either side of the main electrode. A sub-electrode of the pair of sub-electrodes may be in a periphery of a corresponding discharge cell and may be positioned at least partially over the barrier ribs defining the corresponding discharge cell.

At least one of the first and second layers may redirect light incident thereon toward the second substrate. The second layer may redirect light away from the first layer. The second layer may be a reflective layer. The second layer may be inclined. The address electrodes may be on the first substrate and the first and second opaque electrodes may be on the second substrate.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
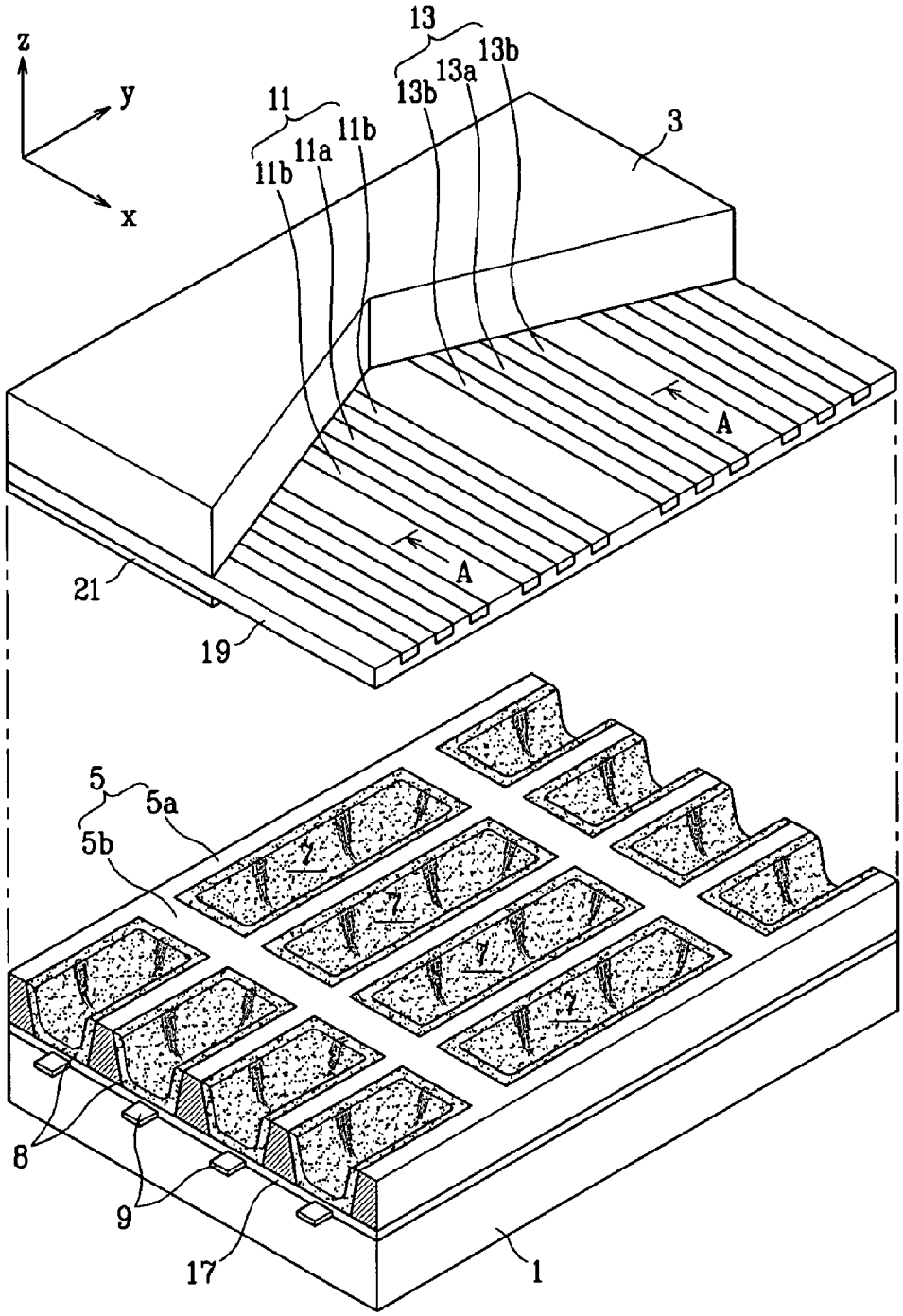
FIG. 1 illustrates a partial perspective view of a disassembled plasma display panel in an embodiment of the present invention.

Korean Patent Application No. 10-2004-0093071 filed on Nov. 15, 2004 in the Korean Intellectual Property Office, and entitled "Plasma Display Panel" is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
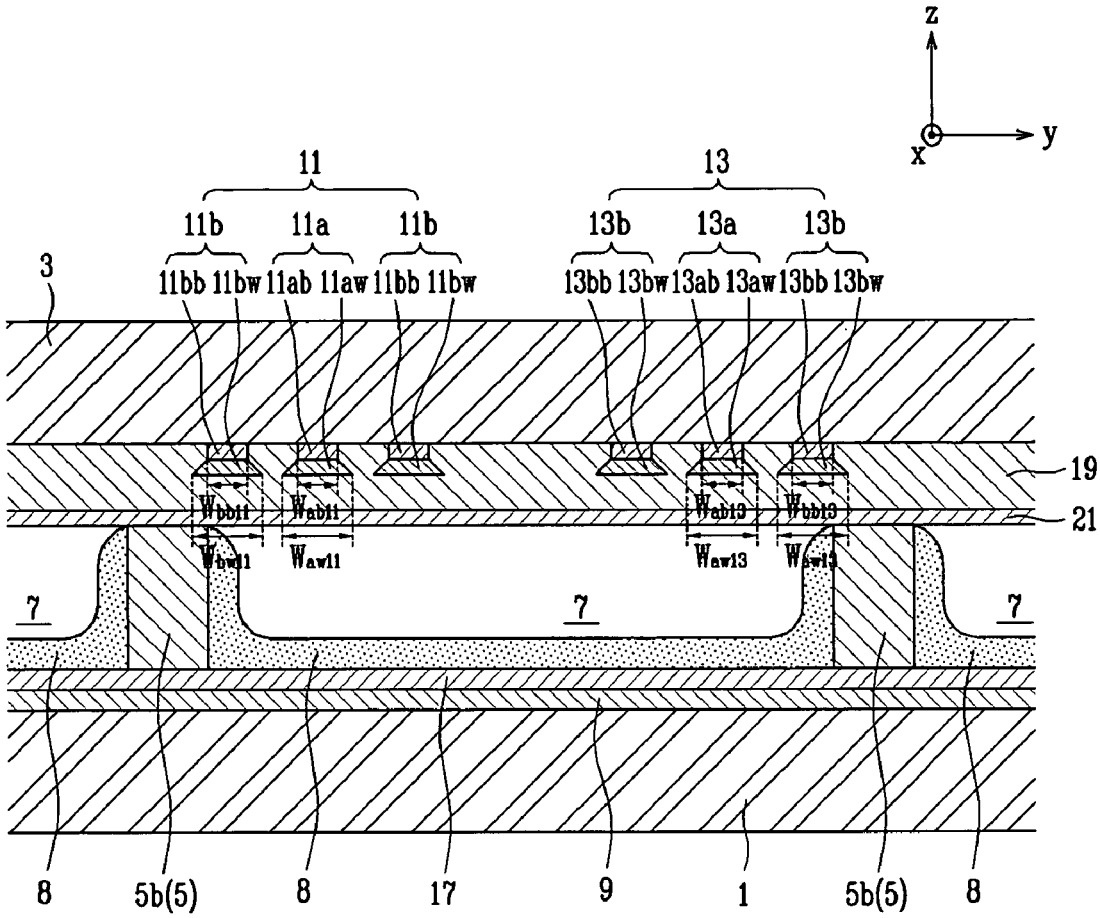
FIG. 2 illustrates a sectional view of the assembled plasma display panel taken along the section line A-A of FIG. 1.

As shown in FIGS. 1 and 2, a plasma display panel (PDP) may include a first substrate 1 (a rear substrate) and a second substrate 3 (a front substrate), facing each other and sealed at their edges. A discharge gas may fill a discharge space between the rear substrate 1 and the front substrate 3. Barrier ribs 5 may be positioned between the rear substrate 1 and the front substrate 3 and may partition the discharge space by defining sidewalls of discharge cells 7. A phosphor layer 8 may be coated on the inside of the discharge cells 7.

Address electrodes 9 may extend in a first direction, e.g., the y-direction, on one side of the rear substrate 1, i.e., the side having the discharge cells 7 formed thereon. Pairs of a first electrode 11 (a sustain electrode) and a second electrode 13 (a scan electrode) may extend in a second direction, e.g., the x-direction, orthogonal to the address electrodes 9 on one side of the front substrate 3, i.e., the side facing the rear substrate 1. Thus, the discharge cells 7 are between the address electrodes 9 and the pairs of first and second electrodes 11, 13.

The barrier ribs 5 may be in a stripe pattern with only first barrier rib members 5*a* extending in the same direction (y-direction) as the address electrode 9. Alternatively, both the first barrier rib members 5*a* and second barrier rib members 5*b* extending in the direction crossing the first barrier rib members 5*a*, may form a lattice pattern, as shown in FIG. 1. The discharge cells 7 may be formed by the barrier ribs 5 into various shapes including polygons, e.g., rectangles, hexagons and octagons.

A dielectric layer 17 may be formed on a rear substrate 1 on a surface facing the front substrate 3. The dielectric layer 17 may cover the address electrodes 9 located on the rear substrate 1. The dielectric layer 17 may enable accumulation of wall charges during the address discharge. Therefore, the dielectric layer 17 may define a lower surface of the discharge cell 7.

A dielectric layer 19 and a protective layer 21 may be formed in layered structure on a front substrate 3 on a surface facing the rear substrate 1. The dielectric layer 19 may cover the sustain electrodes 11 and the scan electrodes 13 and may enable accumulation of wall charges during the address discharge and the sustain discharge. Therefore, the protective layer 21 may define an upper surface of the discharge cell 7.

Therefore, the discharge cell 7 located between the rear substrate 1 and the front substrate 3 is defined by the dielectric layer 17 on the rear substrate 1, the inner walls of the barrier ribs 5 and the protective layer 21 on the front substrate 3.

In operation, an address discharge occurs by applying scan pulses to the scan electrode 13 and address pulses to the address electrode 9 of a selected discharge cell 7 to be turned on. Following the address discharge, sustain discharge pulses are alternately applied to the sustain electrode 11 and the scan electrode 13, causing a surface discharge in the selected discharge cell 7. The phosphor layer 8 on the surfaces of the dielectric layer 17 and the inner walls of the barrier ribs 5 of the discharge cell emits visible light during the sustain discharge. The visible light emitted by the phosphor layer 8 is directed toward the front substrate 3.

In the present embodiment, the sustain electrode 11 and the scan electrode 13 serve to apply the sustain pulse voltage required for the sustain discharge and the resetting pulse voltage. The scan electrode 13 also serves to apply the scan pulse voltage. However, the roles of the sustain electrode 11 and the scan electrode 13 may be changed depending on the voltage pulses imposed to each electrode and therefore, are not limited to the aforementioned roles.

The sustain electrode 11 and the scan electrode 13 may be formed on the facing sides of the second barrier rib member 5*a* placed in the direction orthogonal to the address electrode 9 so as to selectively drive neighboring discharge cells 7. Alternatively, the sustain electrode 11 and the scan electrode 13 may be formed independently in each discharge cell 7 to drive each discharge cell 7, as shown in FIGS. 1 and 2.

Each of the sustain electrode 11 and the scan electrode 13 may include an opaque bus electrode and may extend in the direction orthogonal to the address electrode 9. In order to enable the inter-surface discharge and to obtain the required opening ratio, the sustain electrode 11 and the scan electrode 13 may be formed in a parallel structure having a plurality of main electrodes 11*a*, 13*a* and sub-electrodes 11*b*, 13*b*, as shown in FIGS. 1 and 2. The sub-electrodes 11*b*, 13*b* may be formed on both sides of the main electrodes 11*a*, 13*a*, and identical sustain pulse voltages may be applied to the main electrodes 11*a*, 13*a* and the sub-electrodes 11*b*, 13*b*. In addition, since the main electrodes 11*a*, 13*a* and the sub-electrodes 11*b*, 13*b* may be formed separate from each other, both a wide area for discharging in the discharge cell 7 and a high transmittance of visible light may be realized.

The sub-electrodes 11*b*, 13*b* located near a center of the discharge cell 7 may be close together so that discharging can be started at a low voltage. As a result, the full sustain discharge may be induced effectively between the main electrodes 11*a*, 13*a* at a reduced power consumption. The sub-electrodes 11*b*, 13*b* located at a periphery of the discharge cell 7 may be close to the barrier ribs 5, allowing the phosphor layer 8 to be excited in a wide area by spreading the full sustain discharge between the main electrodes 11*a*, 13*a* toward the barrier ribs 5.

The main and sub-electrodes 11*a*, 13*a*, 11*b*, 13*b* may be formed in layered structure having a black layer 11*ab*, 13*ab*, 11*bb*, 13*bb* as a first layer and a white layer 11*aw*, 13*aw*, 11*bw*, 13*bw* as a second layer. The black layer 11*ab*, 13*ab*, 11*bb*, 13*bb* may be made of, e.g., one or more of cobalt (Co), chromium (Cr) and ruthenium (III) oxide ($Ru_2O_3$), so as to absorb outside light and enhance the contrast of the PDP. The white layer 11*aw*, 13*aw*, 11*bw*, 13*bw* may be made of, e.g., silver (Ag) or aluminum (Al), so as to improve the conductance of the electrode. Within the allowance range for the contrast, the main and sub-electrodes 11*a*, 13*a*, 11*b*, 13*b* may have the black layer 11*ab*, 13*ab*, 11*bb*, 13*bb* as narrow as possible and the white layer 11*aw*, 13*aw*, 11*bw*, 13*bw* as wide as possible, so that the required conductance may be obtained while blocking a minimal amount of visible light emitted from the phosphor.

Thus, the width $Wab_{11}$, $Wab_{13}$, $Wbb_{11}$, $Wbb_{13}$ of the black layer 11*ab*, 13*ab*, 11*bb*, 13*bb* may be narrower than the width $Waw_{11}$, $Waw_{13}$, $Wbw_{11}$, $Wbw_{13}$ of the white layer 11*aw*, 13*aw*, 11*bw*, 13*bw*. In other words, the black layer 11*ab*, 13*ab*, 11*bb*, 13*bb* may have a smaller surface area than the white layer 11*aw*, 13*aw*, 11*bw*, 13*bw*. Therefore, the black layer 11*ab*, 13*ab*, 11*bb*, 13*bb* may enhance the contrast by maximizing the absorption of outside light while minimizing the amount of light for display being blocked.

As shown in FIG. 2, the black layer 11*ab*, 13*ab*, 11*bb*, 13*bb* may be formed on the front substrate 3 side, and the white layer 11*aw*, 13*aw*, 11*bw*, 13*bw* may be formed on the discharge cell 7 side of the black layer 11*ab*, 13*ab*, 11*bb*, 13*bb*. Alternatively, the white layer 11*aw*, 13*aw*, 11*bw*, 13*bw* may be formed on the front substrate 3 side, and the black layer 11*ab*, 13*ab*, 11*bb*, 13*bb* may be formed on the discharge cell 7 side of the white layer 11*aw*, 13*aw*, 11*bw*, 13*bw* (not shown).

The width of the white layer 11*aw*, 13*aw*, 11*bw*, 13*bw* on the side facing the front substrate 3 may be less than that facing the discharge cell 7. For example, as shown in FIG. 2, both edge sides of the white layer 11*aw*, 13*aw*, 11*bw*, 13*bw* may be inclined. Additionally, both edge sides of the white layer 11*aw*, 13*aw*, 11*bw*, 13*bw* may be formed in various shapes for redirecting light, e.g., a rounded shape.

At least a part of the sub-electrodes 11*b*, 13*b* located at the periphery of the discharge cell 7 may pass over the barrier ribs 5, particularly over the second barrier rib members 5*a*. This arrangement may prevent the visible light generated in the selected discharge cell 7 from leaking to a non-discharge region outside the selected discharge cell 7.

Figure 3:
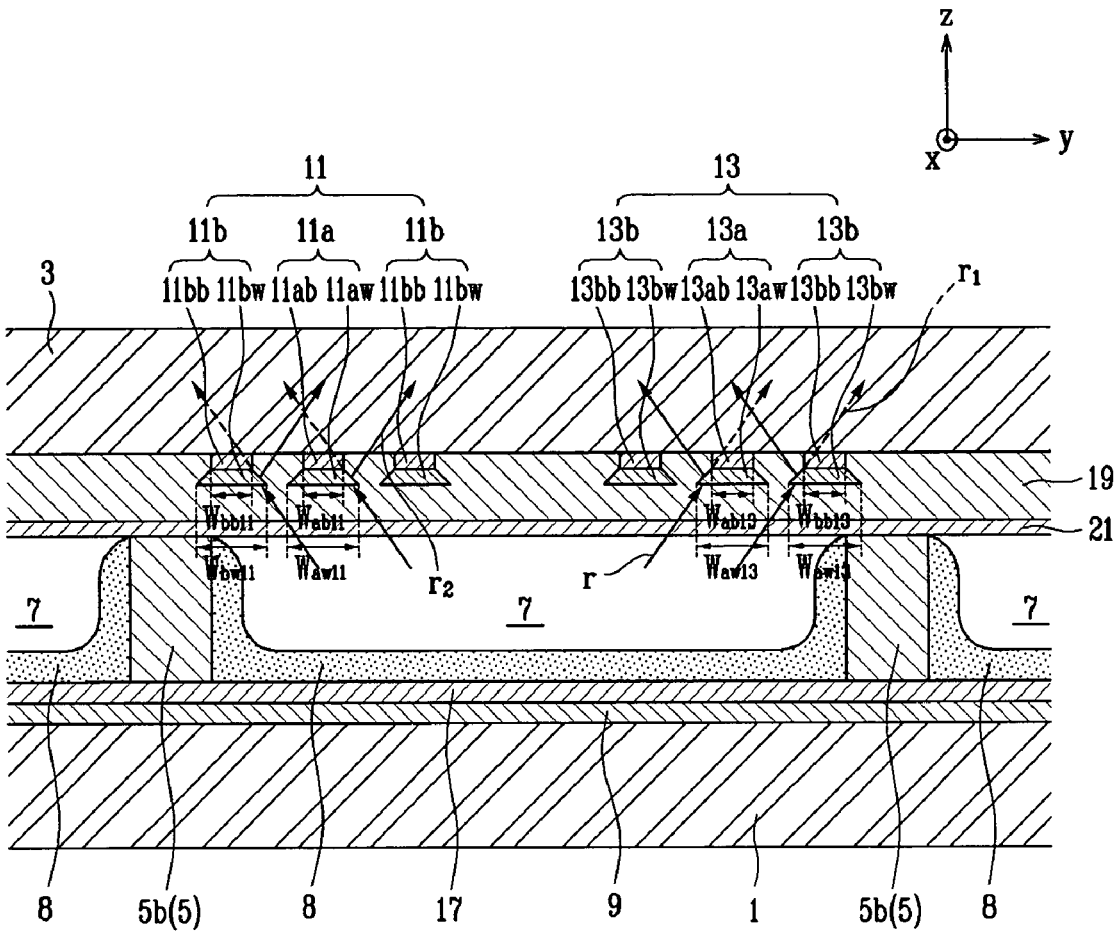
FIG. 3 illustrates a schematic view showing the driving state in which visible light is reflected and transmitted in the plasma display panel according to the embodiment of the present invention.

In FIG. 3, a solid line r incident on the electrodes indicates the visible light generated in the discharge cell 7, a dashed line $r_1$ indicates the path the visible light r would have taken if the electrode was not there and a solid line $r_2$ indicates how the visible light r is redirected to the front substrate 3 by the white layers of the electrodes. FIG. 3 is not a precise optical ray trace, but is provided for illustrative purposes.

As shown in FIG. 3, if not redirected by the white layers, the visible light r would be blocked by the black layer 11*ab*, 13*ab*, 11*bb*, 13*bb*. However, in accordance with an embodiment of the present invention, the visible light r is redirected from $r_1$ to $r_2$, and proceeds toward the front substrate 3. Thus, the degraded transmittance of the visible light by the black layer 11*ab*, 13*ab*, 11*bb*, 13*bb* may be compensated effectively. The redirected visible light $r_2$ may pass through the gap between the main and sub-electrodes 11*a*, 13*a*, 11*b*, 13*b*.

The sustain electrode 11 and the scan electrode 13 according to an embodiment of the present invention as discussed above may enhance the transmittance of the visible light at the center of the discharge cell 7 and near the barrier ribs 5 by forming the black layer 11*ab*, 13*ab*, 11*bb*, 13*bb* to be narrower than the white layer 11*aw*, 13*aw*, 11*bw*, 13*bw*. Moreover, both edge sides of the white layer 11*aw*, 13*aw*, 11*bw*, 13*bw* may be inclined to increase the transmittance of the visible light and the luminance of the PDP, i.e., by redirecting visible light that would have been blocked by the black layer 11*ab*, 13*ab*, 11*bb*, 13*bb* to the front substrate 3.

Thus, the plasma display panel of an embodiment of the present invention may use only opaque bus electrodes while having enhanced luminance. In particular, the opaque bus electrodes may have a black layer and a white layer, the black layer being narrower than the white layer. Both edge sides of the white layer of the opaque bus electrode may be inclined or otherwise shaped so that visible light that would have been blocked by the black layer is redirected toward the front substrate.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel, comprising:

a first substrate;

a second substrate facing the first substrate;

address electrodes on the first substrate;

barrier ribs between the first and the second substrates, the barrier ribs defining discharge cells;

phosphor in each discharge cell; and first and second opaque electrodes extending orthogonally to the address electrodes on the second substrate, wherein each opaque electrode includes a first layer on the second substrate and a second layer on the first layer, the first layer being narrower than the second layer, each discharge cell being between a corresponding address electrode on a first side and a corresponding pair of first and second opaque electrodes on a second side, opposite the first side, and wherein each of the first and second opaque electrodes is entirely and directly on the second substrate.

2. The plasma display panel as claimed in claim 1, wherein the first layer is a black layer and the second layer is a white layer.

3. The plasma display panel as claimed in claim 1, wherein the first layer includes at least one component selected from a group including cobalt (Co), chromium (Cr) and ruthenium (III) oxide ($Ru_2O_3$), and the second layer includes silver (Ag) or aluminum (Al).

4. The plasma display panel as claimed in claim 1, wherein the first layer is on a second substrate side, and the second layer is on a discharge cell side.

5. The plasma display panel as claimed in claim 4, wherein the second layer is narrower on the second substrate side than on the discharge cell side.

6. The plasma display panel as claimed in claim 5, wherein an edge of the second layer is inclined.

7. The plasma display panel as claimed in claim 1, wherein each opaque electrode includes a main electrode and a sub-electrode in parallel.

8. The plasma display panel as claimed in claim 1, wherein each opaque electrode includes a main electrode and a pair of sub-electrodes in parallel, the sub-electrodes being on either side of the main electrode and coplanar with the main electrode.

9. The plasma display panel as claimed in claim 8, wherein a sub-electrode of the pair of sub-electrodes is in a periphery of a corresponding discharge cell and is positioned at least partially over the barrier ribs defining the corresponding discharge cell.

10. The plasma display panel as claimed in claim 1, wherein at least one of the first and second layers redirects light incident thereon toward the second substrate.

11. The plasma display panel as claimed in claim 10, wherein the second layer redirects light toward the second substrate.

12. The plasma display panel as claimed in claim 11, wherein the second layer redirects light away from the first layer.

13. The plasma display panel as claimed in claim 11, wherein the second layer is a reflective layer.

14. The plasma display panel as claimed in claim 11, wherein the second layer is inclined.

15. A plasma display panel, comprising: a first substrate; a second substrate facing the first substrate; address electrodes on the first substrate; barrier ribs between the first and the second substrates, the barrier ribs defining discharge cells; phosphor in each discharge cell; and first and second opaque electrodes extending orthogonally to the address electrodes on the second substrate, wherein each of the first and second opaque electrodes is entirely and directly on the second substrate and includes means for redirecting light incident thereon toward the second substrate.

16. The plasma display panel as claimed in claim 15, wherein the means for redirecting light comprises a reflective surface.

17. The plasma display panel as claimed in claim 15, wherein the means for redirecting light comprises a shaped surface.

18. The plasma display panel as claimed in claim 17, wherein the shaped surface is an inclined surface.

19. The plasma display panel as claimed in claim 18, wherein the inclined surface is inclined towards the second substrate.

20. The plasma display panel as claimed in claim 4, wherein edges of the first layer are perpendicular to an interface between the first and second layers, and edges of the second layer are beveled with respect to the interface between the first and second layers.

* * * * *